US007178568B2

(12) United States Patent
Wynona

(10) Patent No.: US 7,178,568 B2
(45) Date of Patent: Feb. 20, 2007

(54) NOVELTY PURSE

(76) Inventor: Krystal Wynona, P.O. Box 1238, Angel's Camp, CA (US) 95222

( * ) Notice: Subject to any disclaimer, the term of this patent is extended or adjusted under 35 U.S.C. 154(b) by 295 days.

(21) Appl. No.: 10/803,217

(22) Filed: Mar. 18, 2004

(65) Prior Publication Data

US 2005/0205178 A1 Sep. 22, 2005

(51) Int. Cl.
*A45C 1/02* (2006.01)

(52) U.S. Cl. ..... 150/129; 150/108; 150/130; 150/127; 150/128; 206/309; 206/312

(58) Field of Classification Search ..... 150/108, 150/127, 128, 129, 130; 383/116; D3/303, D3/321, 232, 234
See application file for complete search history.

(56) References Cited

U.S. PATENT DOCUMENTS 1,361,761 A * 12/1920 Gay ..... 224/611
1,768,496 A * 6/1930 Trager ..... 190/119
2,166,360 A * 7/1939 Lewis ..... 150/127
2,259,204 A * 10/1941 Fulton ..... 24/13
2,311,847 A * 2/1943 Long ..... 150/129
2,334,410 A * 11/1943 Hume ..... 150/127
2,922,451 A * 1/1960 White ..... 150/126
3,415,300 A * 12/1968 Worcester ..... 150/106
3,826,360 A * 7/1974 Shore ..... 206/312
D260,325 S * 8/1981 Davis ..... D3/234
4,566,590 A * 1/1986 Manning et al. ..... 206/232
5,207,717 A * 5/1993 Manning ..... 206/232
D384,201 S * 9/1997 Petto ..... D3/238
D387,200 S * 12/1997 Kuhn ..... D3/243
D394,748 S * 6/1998 Petto ..... D3/238
6,446,417 B1 * 9/2002 Lux et al. ..... 53/462
6,976,579 B2 * 12/2005 Molnar et al. ..... 206/308.1

* cited by examiner

*Primary Examiner*—Tri M. Mai
(74) *Attorney, Agent, or Firm*—Mark C. Jacobs

(57) ABSTRACT

A woman's purse to be hand or shoulder carried, and which has a front face panel of a record jacket attached to a substrate and a rear surface panel formed of a vinyl record preferably laminated for protection, attached to a substrate. The two side and bottom panels form a generally U-shaped section which is attached to each of the front and rear panels, but not attached to the two top edges of the front and rear panels. A handle(s) can be conventionally attached. The purse may be lined and have accessories attached to the interior thereof.

16 Claims, 4 Drawing Sheets

NOVELTY PURSE

FIELD OF THE INVENTION

This application pertains to a novelty purse or pocketbook suitable for women of all ages that can be hand carried or used as a shoulder bag.

BACKGROUND OF THE INVENTION

Every woman from age 12 on up is interested in fashion, and that is dressing smart. In today's world smart fashion dictates that the wardrobe must include some items that are both practical and good looking. Women like something that appears to be new and exciting without having the cost burden of a Rome or Paris original. The purses of this invention, or pocketbooks, as they are known in the Eastern USA, are both practical and useful as well as high styled. They are easily recognizable as being the creation of a particular artist.

Not only are the products of this invention stylish, but they are good for the environment as they utilize materials that have been recycled.

The invention accordingly comprises the device possessing the features properties and the relation of components which are exemplified in the following detailed disclosure and the scope of the application of which will be indicated in the appended claims.

For a fuller understanding of the nature and objects of the invention reference should be made to the following detailed description, taken in conjunction with the accompanying drawings.

SUMMARY OF THE INVENTION

A woman's purse that can be carried in the hands or over the shoulder, which bag has a body with one side of its body made in part from the jacket of a 33 rpm record, and the other side of its body being made in part from the same or a different vinyl 33 rpm phonograph record. Rivets are preferred for assembly and a nylon webbing is used to form gussets for the sides. Interior compartments are conventional as is the presence of an adjustable strap, which optionally can be removable.

It is a first object to provide a novel looking purse for women.

It is a second object to provide a purse whose body is substantially weatherproof.

It is a third object to provide a purse which is primarily black on one of its two faces and which features graphic art on the other face.

It is a fourth object to provide a strong damage resistant purse that is unique in appearance on both its front and rear panels.

Other objects of the invention will in part be obvious and will in part appear hereinafter.

DESCRIPTION OF THE PREFERRED EMBODIMENT

Figure 1:
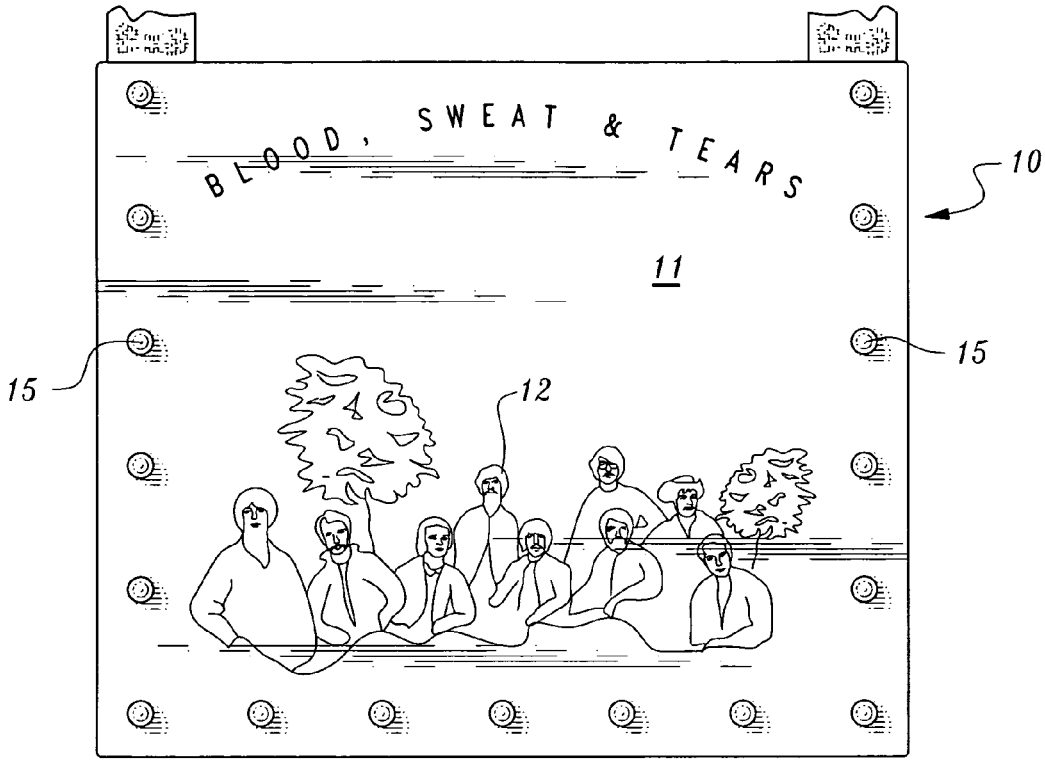
FIG. 1 is a partial front elevational view of the pocketbook of this invention.

FIG. 1 illustrates a typical graphical record jacket that is utilized in the construction of the front panel 26 of this invention. Here it is the front of an album by the group Blood Sweat and Tears. It could just as easily been an album jacket front from an offering by Whitney Houston, Sammy Davis Jr., Frank Sinatra, Dean Martin, Elvis Presley, Lawrence Welk or even the Philadelphia Orchestra. Any record jacket cover can be utilized as the graphic 12 for the front face 11 of this invention 10. The term panel as used herein constitutes the several elements that form it. One of the elements in some panels is a solid surface designated a substrate.

Designator 15 is for one of a series of rivets used in the assembly of this invention. More will be recited concerning the assembly of this device, infra.

Figure 2:
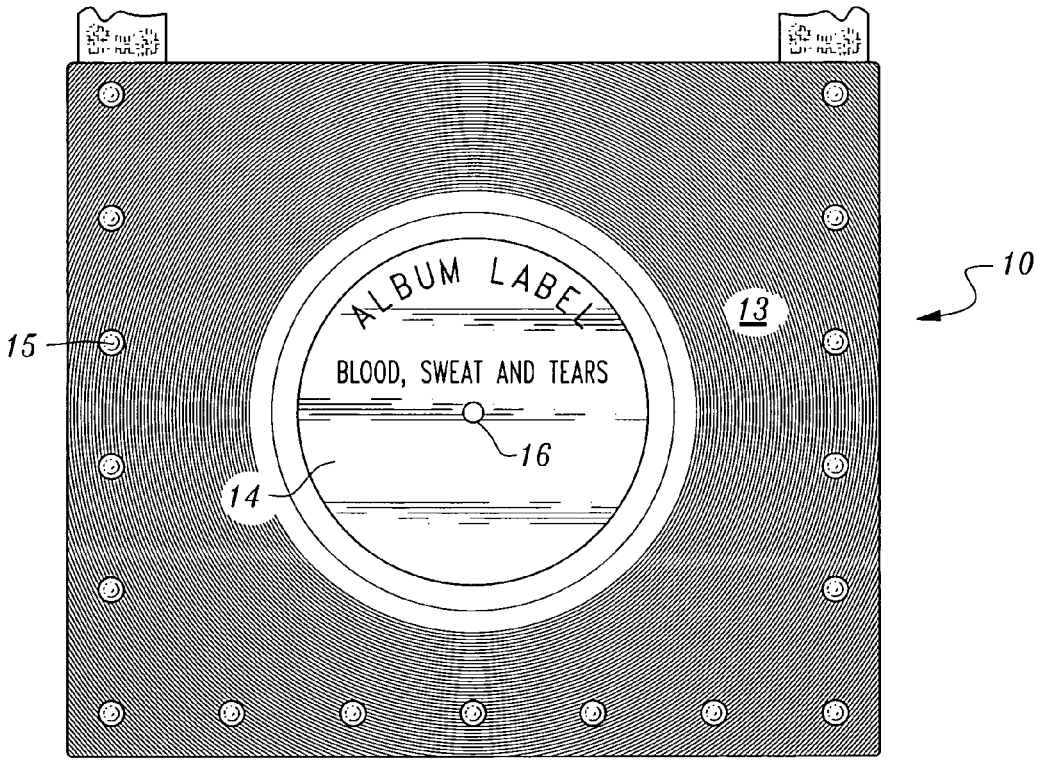
FIG. 2 is a view similar to FIG. 1 showing the rear elevation.

In FIG. 2, the reverse or back face 13 of this invention is seen. It too is a panel 26, which is formed in part from an actual cut to size vinyl record, complete with label 14 and spindle hole 16. The record, which preferably is the same record as would have been found in the jacket utilized in the manufacture of front face. The record after being cut to size is preferably adhesed in place on the chosen substrate and then riveted in to position for permanent placement. The panel here is the combination of the record attached to the substrate. The opposed front panel 24 is the combination of the preferably laminated graphic and its substrate. Again designator 15 is the rivet used for assembly of that face of the purse. Other panels or faces are made of other materials as will be discussed. The vinyl is glued and riveted to a substrate, see infra.

Figure 3:
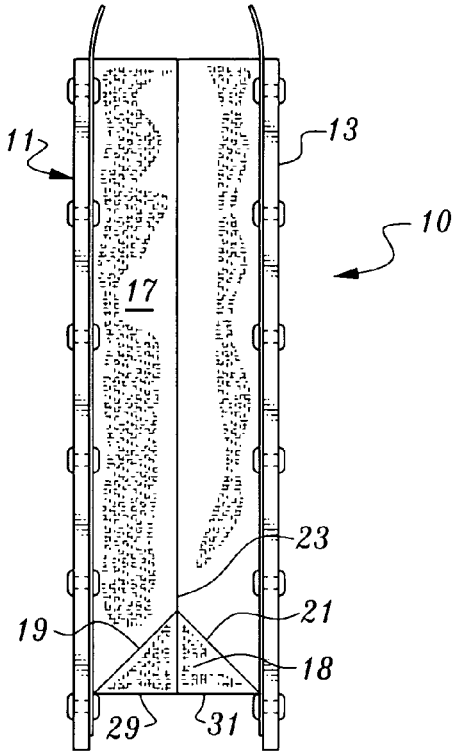
FIG. 3 is a partial side perspective view of the device of this invention.
Figure 4:
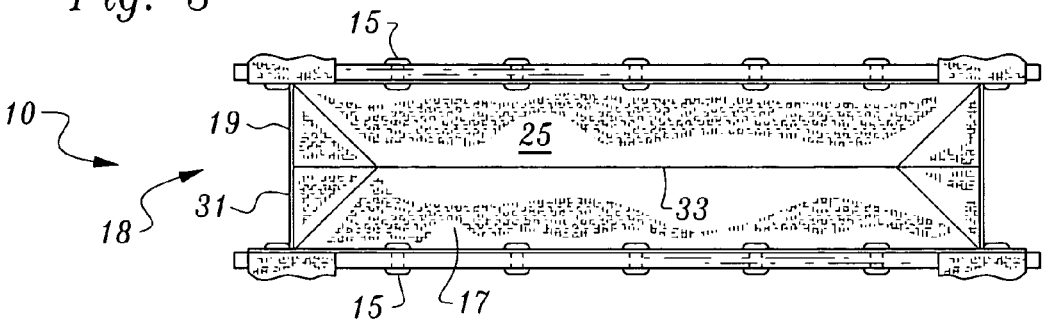
FIG. 4 is a top perspective view of this device.
Figure 5:
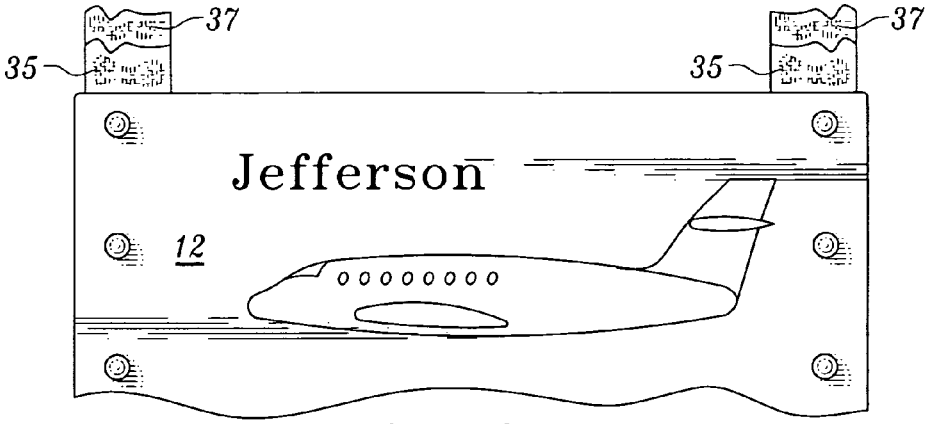
FIG. 5 is a side elevational view thereof.

In FIG. 3 the side elevation is seen. Front face 11 is connected to back face 13 by side mesh 17. As can be seen the mesh is retained by rivets 15 which may be brass or black or chrome plated as may be desired. This one piece of mesh 17 has folds 19 and 21 at the bottom to form a gusset 18 with a fold line 23 down the middle. To complete the turn to form the bottom of the purse, two folds 29 and 31 are formed. Reference is made now to FIG. 4, though one should bear in mind that the while FIG. 5 illustrates the right side of the pocketbook, the left side is a mirror image thereof.

In FIG. 4, the continuation of the side mesh panel 17 is seen as bends underneath at a 90-degree bend via the gusset 18 to form bottom panel 25. The second side panel is the same construction as first side panel 17 and need not be specifically discussed. Bottom mesh panel 25 also includes a crease 33 which flattens out when the purse is opened wide. Any nylon or other fabric mesh, or solid material such as satin, cotton, polyester, canvas and the like, may be utilized for the sides and bottom of this purse. Thus a U-shaped section of mesh which incorporates the creases and folds aforementioned are attached to the front and rear panels to form the body of the purse.

The two handles 35 and 37 may be formed of nylon webbing which is readily available in the marketplace, or other material or solid plastic handles may be employed. If desired only one handle need be utilized. The flexible material handles are preferred to reduce storage space. The handles are attached by rivets 15 or another conventional attachment means, such as stitching.

Figure 7:
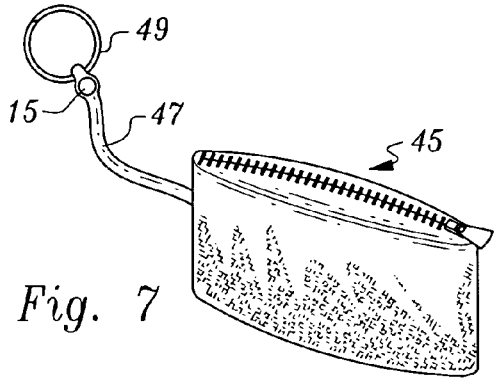
FIG. 7 is a perspective view of an extra value component that can be added to this invention.

In FIG. 7 an accessory chain purse 45 is shown. Typical zipper operated, change purses are available in leather or cloth from vendors in the USA and Mexico as well as other countries. To the purse is attached a tether 47 which can be a piece of webbing, or woven cloth such as resembling a shoelace. Tether 47 is conventionally attached to the change purse at one end and the other end has an eyelet 49 for attachment to the purse via a rivet 15 as shown or other conventional means.

Figure 8:
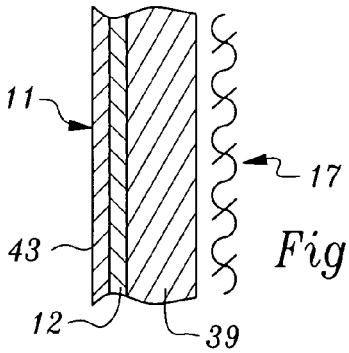
FIG. 8 is a diagrammatic view that illustrates the construction of this device.
Figure 6:
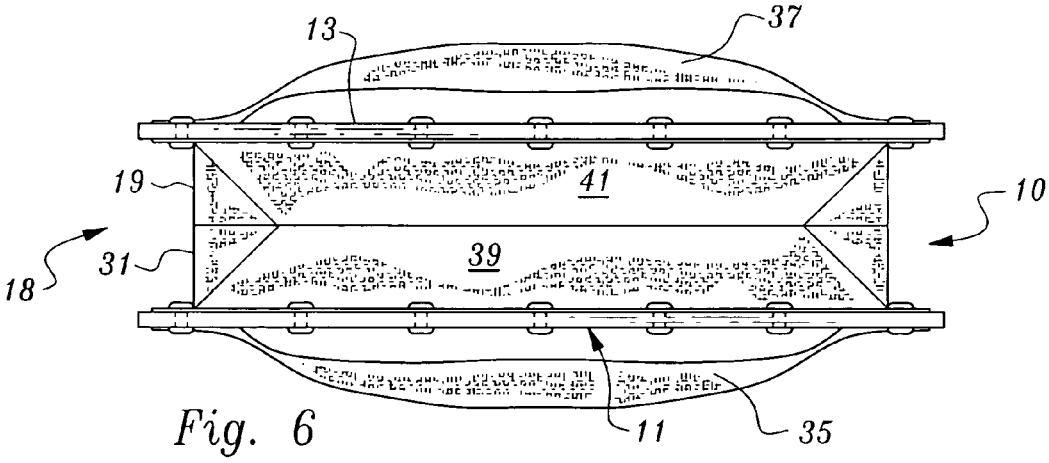
FIG. 6 is a bottom plan view of this invention.

In FIG. 8 the actual construction of this pocketbook. Here only one face is illustrated, though the other face is of the same construction but in mirror image arrangement. Face 11 includes a first layer 43 which is a clear plastic laminate sheet having a pressure activated adhesive—not specifically illustrated—thereon. The clear laminate is overlaid onto the graphic image 12, which has been previously adhesed to the interior substrate which substrate may be any rigid self-supporting material substrate such as but not limited to Masonite®, plywood or plastic, as may be desired. Optionally the interior surface of the substrate 39 may be painted a color as may be desired, or covered over with a fabric such as satin as a lining 53 shown in FIG. 11. Designator 17 is the mesh or other material used for the sides of this purse as shown in FIG. 3. The laminate layer 43 not only overlies the graphic 12, but it overlies the edge of the substrate 39. To achieve this result, the graphic 12 should be sized slightly smaller than the substrate 39 to permit the overlay of the laminate 43's edge to the substrate 39. The corresponding substrate of plywood or Masonite® is designated 41 and is seen in FIG. 6.

Figure 9:
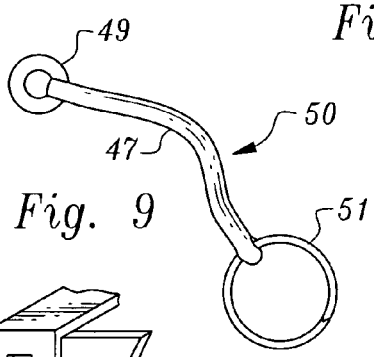
FIG. 9 is a perspective view of a second extra value component that can be added to this invention.

In FIG. 9 a second accessory usable with this invention is seen. Here a key holder 50 comprising a tether 47 having a split ring 51 disposed at one end, and an eyelet 49 at the other end is seen. The split ring is attached in conventional form as by wrapping the tether through the ring and sewing the tether end up onto to the tether.

Figure 12:
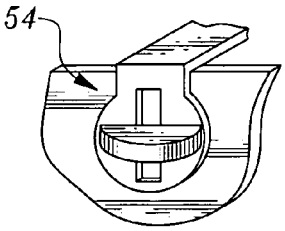
FIG. 12 is a closeup view of the closure for a purse/pocketbook shown in FIG. 10.
Figure 10:
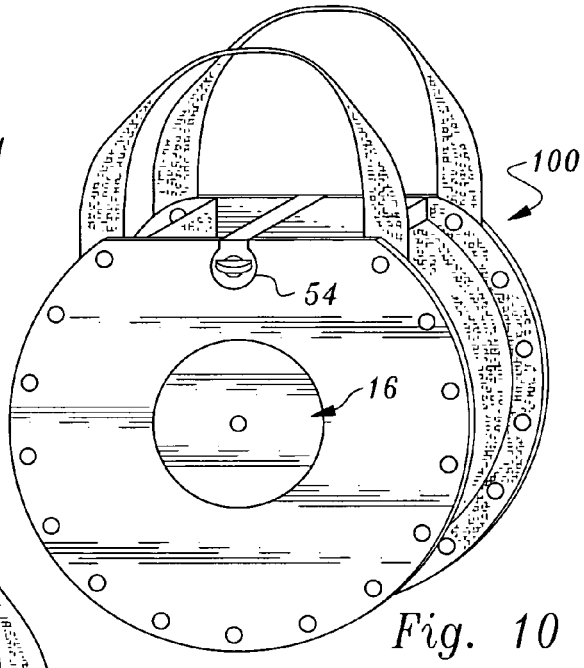
FIG. 10 is a side perspective of an alternate configuration for this device.

While the discussion and drawings have shown a square cornered pocketbook, which would be a rectangle or square, the device is not so limited. FIG. 10 illustrates a variant on the shape, namely round. If desired the spindle opening 16 can be painted a contrasting color or black or left such that the substrate surface shows through, as may be desired. FIG. 12 illustrates a closeup of the closure of the purse shown in FIG. 10. See designator 54.

Figure 11:
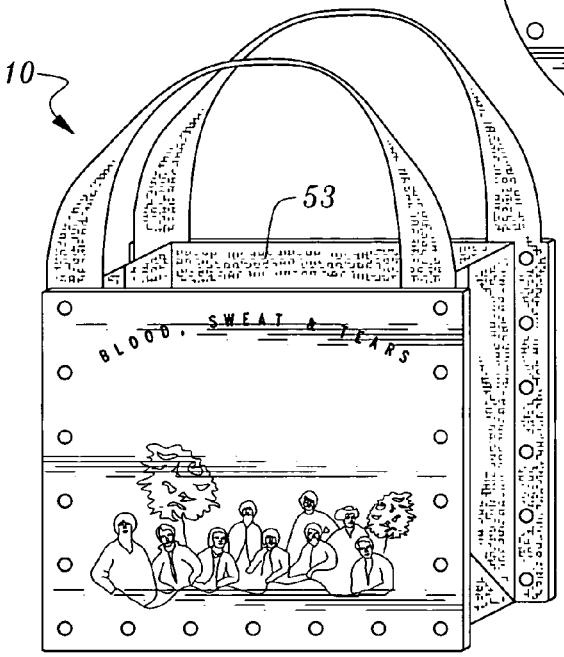
FIG. 11 is a full perspective view of the pocketbook of this invention.

FIG. 11 is a perspective view of the rectangular version of this pocketbook. Note that it is lined with as with satin 53 to increase upscale consumer appeal.

Figure 14:
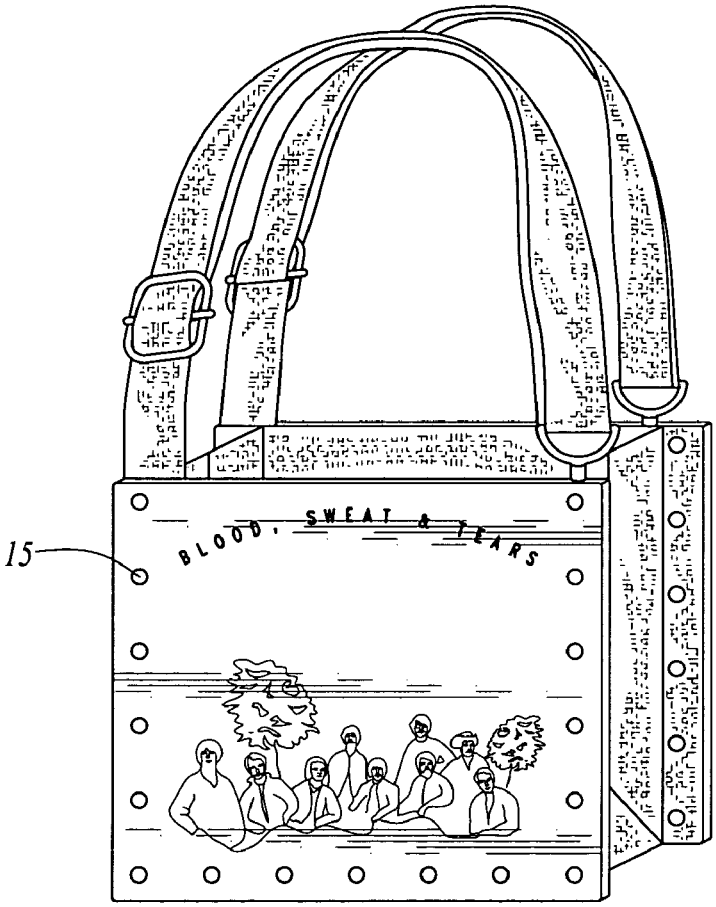

FIG. 14 illustrates the fact that the two handles can be made adjustable in size by using conventional buckles adapted for that purposed. Thus the woman can have a short or long-handled pocketbook as may be desired. The adjustable straps are designated 35A and 37A respectively.

The rivets 15 used for the assembly of this device are known as pop-rivets and are readily available at any hardware store. For use with a handheld riveting machine, other replacements for the rivets may be employed as well.

Figure 13:
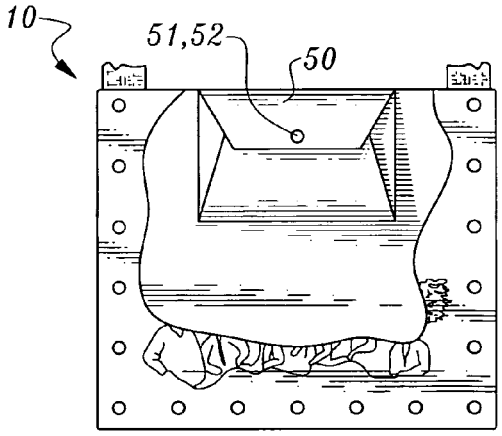
FIG. 13 is a cutaway elevational view of one interior face of this purse with a pocket attached thereto.

It is also within the scope of this invention to include an interior pocket 50 as is shown in FIG. 13. This pocket 50 may be made of satin, leather, or polyurethane which is stitched together and then riveted into a fixed position. While a second row of rivets 15 could be utilized, such would affect the aesthetics of the purse. Thus it is preferred to use the top row of rivets 15 on either face to also hold the pocket in a fixed interior position to the Masonite®. The pocket as shown in FIG. 13 is seen to be interiorly mounted on one face of the purse and is separately closeable by a closure 51,52 which may be a snap system or a hook and loop closure or even a zipper.

It is seen that I have designed and created a large series of exclusive purses, each one of which can be hand selected from one of a multimillion plethora of record jackets. The purse becomes a conversation piece when the actual record of the second face is the one formerly in the record jacket. Buyers can specify their desires according to artist(s) or colors of the graphic 12 as may be desired. Being laminated with a plastic layer on the outside, the purses of this invention are wet weather safe.

An optional snap or hasp or other closure such as 54 shown in FIG. 12 may also be employed on or near the top edge of the front and rear panels.

The entire or any portion of the record jacket may be employed either as a square or cut fancifully to a circle, diamond, octagon etc., when forming the rear panel and used with a corresponding surface area configured rear panel of a record and its substrate cut in like manner.

While mesh has been suggested as the material for the U-shaped section, other materials can be employed as well, such as genuine or imitation leather. The folds or creases permit a more box like structure to be formed when open. The clam shell opening purse can also be created by having each of the arms of the U-shaped section taper from the small at the base of the U to the larger top of the U-shaped section.

It is also within the scope of this invention to include a closure. Since certain changes may be made in the described apparatus without departing from the scope of the invention herein involved, it is intended that all matter contained in the above description and shown in the accompanying drawings shall be interpreted as illustrative and not in a limiting sense.

I claim:

1. A woman's purse comprising a front face panel of a shaped portion of a record jacket attached to a substrate and a rear surface panel comprising a vinyl record, attached to a substrate similarly configured and sized; said purse also having two side panels and a bottom panel, which together form a generally U-shaped structure includes a series of bends and creases to define a purse when open, which U-shaped section made of a member selected from the group consisting of leather and mesh, and having at least one handle, wherein the jacket of one panel matches the record of the other panel, wherein the series of bends and creases define a pleat at the bottom of the U-shaped section.

2. The purse of claim 1 wherein the purse is lined.

3. The purse of claim 2 wherein a key holder is attached to the interior surface of one panel of the purse.

4. The purse of claim 2 further including a closure for said purse.

5. The purse of claim 1 wherein two handles are present, and both are adjustable.

6. A woman's purse comprising a front face panel of a record jacket, attached to a reinforcing substrate, and a rear surface panel comprising at least a portion of a vinyl record attached to a substrate of the same length and width as the at least a portion of a vinyl record, said purse also having two side panels and a bottom panel, which together form a generally U-shaped section, which U-shaped section is attached to the substrate of each of the respective front and rear panels to define the purse, wherein the bottom panel has a series of folds that define a pleat.

7. The purse of claim 6 further including at least one handle.

8. The purse of claim 6 wherein the at least one handle is size adjustable.

9. The purse of claim 6 wherein front face panel is laminated with a clear layer to the substrate.

10. The purse of claim 6 wherein the U-shaped section is made of mesh.

11. The purse of claim 6 wherein the U-shaped section is made of leather.

12. The purse of claim 6 wherein the record jacket utilized the front panel matches the record used on the rear panel.

13. The purse of claim 6 wherein the at least a portion of a vinyl record is in fact an entire 33⅓ LP record.

14. The purse of claim 6 wherein the U-shaped section is riveted to said front and rear panels, and the purse includes a closure.

15. A woman's purse comprising a front panel of a record jacket overlying an equally dimensioned substrate, and a rear panel comprising at least a portion of a vinyl record attached to a substrate of equal dimension;

said purse having two side panels and a bottom panel, which together form a generally U-shaped section, which U-shaped section has folds at the outer edges of the sides of the U-shaped section, one which folds from each side of the U-shaped section is riveted and through the front panel, and the other of which folds is riveted through the rear panel.

16. The purse of claim 1 wherein the U-shaped section is mad of merely and the purse is lined, and said purse has a closure thereon.

* * * * *